United States Patent [19]

Schreder

[11] Patent Number: 4,814,582

[45] Date of Patent: Mar. 21, 1989

[54] COOKER

[75] Inventor: Felix Schreder, Oberderdingen, Fed. Rep. of Germany

[73] Assignee: E.G.O. Elektro-Geräte Blanc u. Fischer, Fed. Rep. of Germany

[21] Appl. No.: 69,399

[22] Filed: Jul. 2, 1987

[51] Int. Cl.[4] ..... H05B 3/70

[52] U.S. Cl. ..... 219/460; 219/457; 219/396

[58] Field of Search ..... 219/460, 457, 458, 459, 219/464, 461, 397, 398, 396; 126/21 A, 21 R

[56] References Cited

U.S. PATENT DOCUMENTS

| | | | |
|---|---|---|---|
| 2,375,047 | 5/1945 | Sutherland | 126/21 R |
| 2,384,262 | 9/1945 | Rutan | 126/21 R |
| 2,569,652 | 10/1951 | Berg | 126/21 R |
| 2,731,962 | 1/1956 | Woodburn | 126/21 R |
| 2,883,978 | 4/1959 | Nelson | 126/21 R |
| 3,327,094 | 6/1967 | Martin | 126/21 A |
| 3,327,095 | 6/1967 | Hanson | 219/451 |
| 3,684,862 | 8/1972 | Fischer | 219/450 |
| 3,832,988 | 9/1974 | Doner | 126/21 R |
| 3,847,135 | 11/1974 | Sherman | 126/21 R |
| 3,866,526 | 2/1975 | Eng | 126/21 R |
| 4,394,565 | 7/1983 | Pills | 219/452 |
| 4,506,141 | 3/1985 | Scott | 219/463 |
| 4,547,642 | 10/1985 | Smith | 219/396 |

FOREIGN PATENT DOCUMENTS

| | | | |
|---|---|---|---|
| 516910 | 9/1955 | Canada . | |
| 60-96839 | 5/1985 | Japan | 126/21 R |
| 449733 | 7/1936 | United Kingdom | 219/460 |

*Primary Examiner*—Teresa J. Walberg

*Attorney, Agent, or Firm*—Steele, Gould & Fried

[57] ABSTRACT

Below a hob (2) with at least one cooking point (3), a cooker has a baking oven muffle (7), which can be upwardly vented by a venting duct (10) through the hob (2), at least at one cooking point (3). Cooking point (3) is formed by a sealed electric hotplate (4) having a hotplate body (11) with a closed cooking point heating surface (13) and carries below the surface the electric heating elements (20) in a completely sealed form. In the center (14), which is free from heating elements, hotplate body (11) has a through opening (27) which traverses the heating surface (13) and which forms the upper end of venting duct (10). Electric hotplate (4) can be raised upwards from hob (2), which also breaks the connection between hotplate body (11) and baking oven muffle (7) formed by the venting duct (10).

17 Claims, 2 Drawing Sheets

COOKER

BACKGROUND OF THE INVENTION

1. Field of the Invention

The invention relates to a cooker having a hob with at least one electrically heated cooking point, a baking oven muffle arranged beneath the cooking point or points and a venting duct permitting the drawing off of vapors, smoke, hot exhalation and the like occuring in the oven muffle.

2. Prior Art

Electric cooking points are known in which the heating means is formed by a spirally or similarly curved tubular heating element arranged in exposed manner in a shell-shaped depression of the hob in such a way that the top of its tubular outer jacket directly forms the cooking point heating surface, i.e. a standing base for the cooking vessel to be heated. In the case of such cooking points the venting duct can be connected to the bottom of the shell-shaped depression in such a way that the vapors and the like can be drawn off upwards between the turns of the tubular heating element or the cooking point heating surface, as well as on the outer circumference thereof. However, compared with sealed electric hotplates, cooking points of this type suffer from disadvantages. They lead to a non-uniform heat transfer to the cooking vessel which causes local overheating. They are relatively sensitive to mechanical damage and they are difficult to clean, particularly as the surfaces of the heating element and the shell-shaped depression, onto which may pass overflowing cooking products, are in all much larger than the base face of the heating surface.

SUMMARY OF THE INVENTION

An object of the present invention is to provide a cooker of the aforementioned type permitting a closed or sealed construction of the cooking surface and which still permits the drawing off of vapors or the like from the baking oven muffle through at least one cooking point.

According to the invention this object is achieved by a sealed hotplate body provided over most of the heating surface, said body receiving the electrical heating element, which forms a closed constructional unit, in sealed form at a limited distance below the closed heating surface and thereby covering the top side of the heating element. The hotplate body with its top forming the heating surface is traversed from its bottom of the heating surface in such a way by the venting duct that the latter passes the heating element in spaced manner. The heating element or the constructional unit which forms it and which appropriately has an elongated heating resistor can e.g. be a wire coil, which is arranged in a spiral groove filled with a molded insulating material on the bottom of the hotplate body and in contact-free manner with respect thereto. The electrical heating element or the associated constructional unit can also e.g. be formed by a tubular heating element, which is spirally engaged on the closed bottom of the hotplate body and in which the heating wire coil is placed in a thin-walled, tubular, metallic outer jacket, which is filled with an insulating material so that the resistance wire is contact-free with respect to the outer jacket.

As a result of the inventive construction, the depression or opening provided in the vicinity of the particular cooking point in the hob can be completely cured on the top side and a through opening for the venting duct can be provided, which only takes up a fraction of said base face of the opening or heating surface, which is completely sealed with respect to the boundaries of the opening of the hob to avoid dirtying effects and whose outer boundary is spacedly completely located within the outer circumference of the heating surface. The hotplate body is preferably traversed by a single through openign of the venting duct, said through opening being located in an area of the hotplate body free from heating elements and preferably in the center thereof within the innermost turn of the spirally wired heating element.

It is possible to use for the inventive construction per se known hotplate bodies made from cast iron, steel or the like, which are centrally provided with a through opening. For example in the case of the hotplate bodies known from U.S. Pat. No. 3,684,862, said through opening can be provided for receiving a temperature sensor, i.e. is substantially tightly closed.

A particularly advantageous construction is obtained if the e.g. tubular venting duct is connected by its upper end directly to the hotplate body and can be, guided in substantially non-contactig manner up to the hotplate body optionally from the baking oven muffle or at least from a cooker casing or housing surrounding said muffle.

To ensure that relatively large objects or cooking product particles do not pass too deeply into the venting duct, in spite of the relatively large cross-section of the through opening in the heating surface, a sieve is provided in the venting duct which extends substantially over the entire internal cross-section thereof and which at the most is positioned so deeply below the heating surface that it can be reached with the fingers of the user's hand. The sieve subdivides the through openings into a plurality of gratinglike individual holes.

If at least one upper part and in particular most of the venting duct is constructed as a closed constructional unit, e.g. removable by plug connections, then in the removed state the venting duct can be very easily cleaned, e.g. in a dishwashing machine.

The removal of the venting duct can be particularly simply realized if a sealed electric hotplate having the hotplate body can be raised as an entity in readily detachable manner from the hob, which also facilitates the cleaning of the hotplate body.

The described and other features of the preferred further developments of the invention can be gathered from the description, claims and drawings, in which each individual feature can be realized individually or combined with other features in various groupings in an embodiment of the invention and in other fields.

BRIEF DESCRIPTION OF THE DRAWINGS

The invention is further described, by way of example, with reference to the accompanying drawings, in which is shown in.

DETAILED DESCRIPTION OF THE PREFERRED EMBODIMENTS

Figure 1:
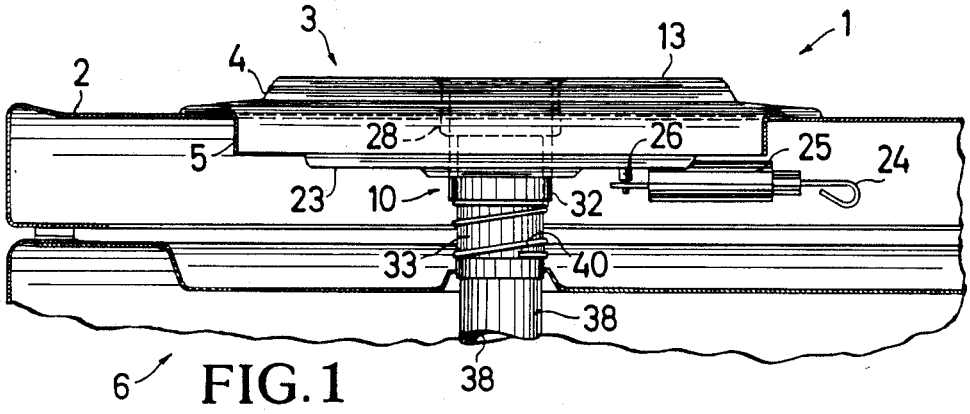
FIG. 1: A detail of an inventive cooker with cut open casing in the vicinity of a single cooking point.
Figure 2:
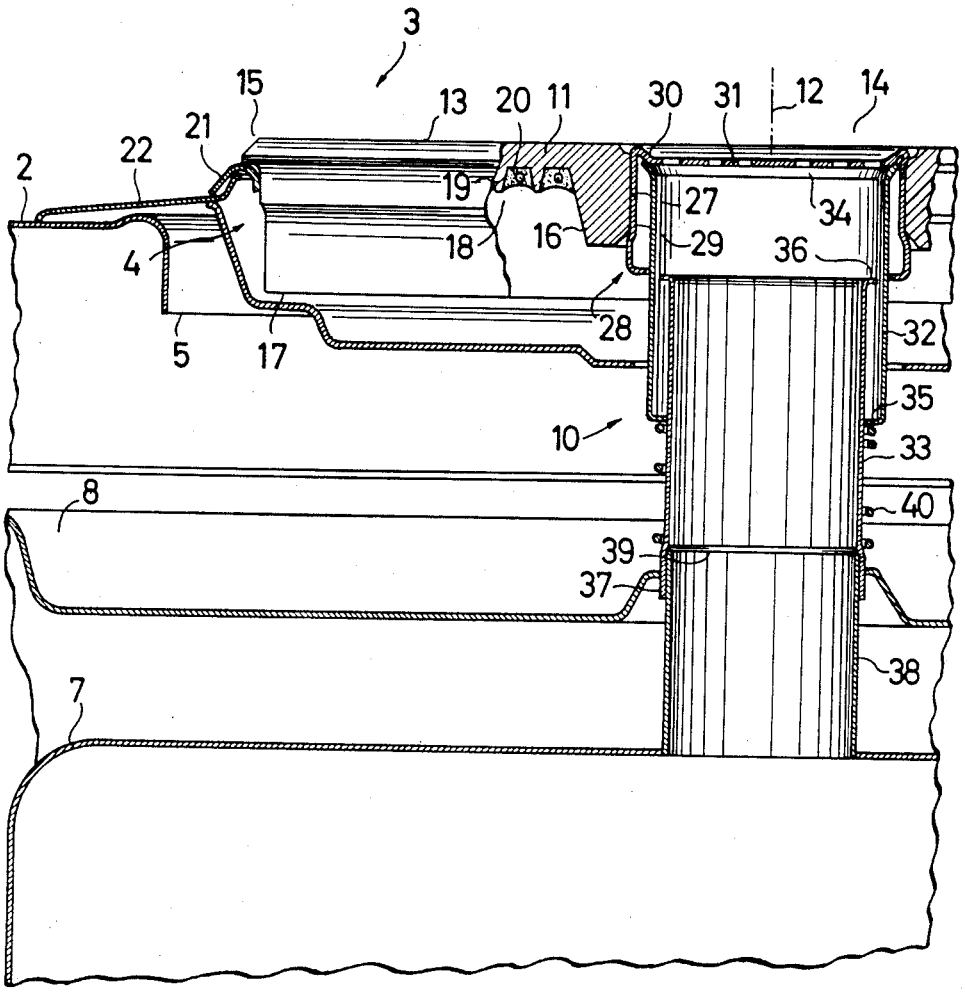
FIG. 2: A detail of the enlarge representation of FIG. 1, the venting duct being shown in sectional form.
Figure 3:
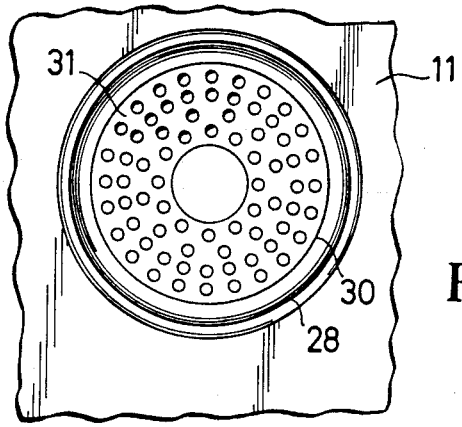
FIG. 3: A plan view of the cooking point according to FIG. 2.

The cooker 1 shown in FIGS. 1 to 3 has a hob 2, e.g. formed by the upper, approximately horizontal wall of a sheet metal body. The cooker is provided with at least one, but in particular two front, juxtaposed cooking points 3 and one or two other cooking points behind there whereof at least one, particularly that at the rear is constructed as an electric cooking point and is formed by a sealed electric hotplate 4. The latter is inserted in a reception opening 5 in hob 2 in the form of a breakthrough, said reception opening 5 being bounded by a cross-sectionally, downwardly directed ring collar. In the manner of a flat casing, hob 2 has a downwardly projecting outer rim, which is bent inwards in the lower region. This hob casing, which projects downwards over the bottom of the sealed electric hotplate 4, is placed as a closed constructional unit on the top of the oven casing 8 of a baking oven 6 having substantially the same plan view. Spacers can be provided between the bottom of the hob casing and the top of the oven casing 8, so that both casings are superimposed with a limited spacing in noncontacting manner. Oven 6 is provided within the oven casing 8 and spaced from the walls thereof with a casing-like oven muffle 7, which is accessible at the front of the oven 6 by means of a casing opening (not shown) which can be closed with an oven door. From the rear wall or the upper, roughly horizontal casing wall of the oven muffle 7 at least one channel-like or tubular thin-wall-bounded venting duct 10 passes upwards through at least one cooking point 3, whereby appropriately each cooking point 3 is at the most traversed by a single venting duct 10 and this traversed cooking point 3 is located adjacent to the back of the cooker 1.

The particular sealed electric hotplate 4 has a hotplate body 11 constructed substantially symmetrically to a central axis 12 and which in plan view can be angular or circular and forms with its substantially planar top surface the cooking point heating surfaces 13, on to which is to be placed the cooking vessel to be heated. The heating surface 13 extends in annularly closed manner about a center 14 forming a field which is offset with respect to heating surface 13 and whose central axis coincides with central axis 12, heating surface 13 being bounded by an outer circumference 15. In the radially inner region of heating surface 13 a freely downwardly projecting, inner annular flanged rim 16 is connected to the bottom of the hotplate body 11 and surrounds the center 13. In the vicinity of outer circumference 15 and slightly inwardly displaced with respect thereto is connected to the underside of the hotplate body 11 an outer, downwardly freely projecting, jacket-like flanged rim 17, which projects further downwards than the flanged rim 16 and, like the latter, is constructed in one piece with the hotplate body 11.

Between the flanged rims 16, 17 is provided at least one spiral groove around the central axis 12 in the bottom 18 of hotplate body 11 substantially parallel to heating surface 13, adjacent groove portions being separated from one another by downwardly projecting rib webs 19 of hotplate body 11. Each groove contains an electrical heating element 20, e.g. in the form of a coiled wire, which is completely embedded in a molded insulating material and is hermetically covered with respect to the heating surface 13, the outer circumference of the cooking point and to the center 14 thereof by means of the hotplate body 11.

To the outer circumference of the outer flanged rim 17 is fixed a cross-sectionally downwardly open shield ring 21, whose top is slightly projected over by a rim of the hotplate body 11 belonging to the heating surface 13 and whose outer side legs slope in downwardly projecting manner, the external diameter of the shield ring 21 being smaller than the internal diameter of the reception opening 5. In the open bottom of the shield ring 21 rigidly fixed to hotplate body 11 engages a thrust ring 22 with an inner, upwardly directed collar, whereby said thrust ring 22 is outer circumferentially provided with a downwardly directed rim, which is lower than the collar, for resting on the hob 2, said rim projecting outwards over the boundary of reception opening 5 roughly by half the width of thrust ring 22. The bottom of the hotplate body 11 is substantially closed by a sheet metal or similar cover 23 projecting over its outer circumference and which has an upwardly directed rim engaging on the underside of thrust ring 22 roughly in the vicinity of the outer side legs of shield ring 21 and clamps the same against the ring edge of the outer side leg of the shield ring 21. By means of not shown fastening members, e.g. screws, cover 23 can be clamped to the bottom of the hotplate body 11.

As a result of the described construction the electric hotplate body 4 is substantially only fitted by placing on hob 2 and is exclusively carried by the slightly self-resilient thrust ring 22 in such a way that the heating surface 13 is positioned slightly above hob 2, and the remaining hotplate body 11 and cover 23 are positioned substantially below the cover wall of hob 2 within the collar defining the reception opening 5. In addition to cover 23, there can be a further cover directly engaging in the outer flanged rim 17 and which is substantially completely located within said rim 17. On said further cover is appropriately fixed a plug 24, which substantially projects radially outwards directly below the flanged rim 17 or the collar of the reception opening 5 and has an insulating body 25 fixed to the bottom of the further cover. The radiallly outwardly projecting, electrically conducting, juxtaposed parts of plug 24 are electrically conductively connected with the heating element or elements 20, the associated lead wires appropriately traversing the further cover, which carries a further insulating body 26 in its bottom for the passage of the lead wires. In the hob casing a matchign plug (not shown) for the electrical connection of heating elements 20 and electrically connected with a manually adjustable temperature regulator or power control device is associated with the plug 24. As a result of the described construction, it is possible to release the sealed electric hotplate 4 merely by lifting upwards from the matching plug and hob 2 and can be correspondingly easily reinserted.

The inner flanged rim 16 defines with its inner circumference a substantially cylindrical passage opening 27, which passes through the hotplate body 11 from the bottom thereof up to heating surface 13 and has a diameter which is approximately between one third and one quarter of the outer diameter of the heating surface 13. An insert in the form of a sheet metal cap 28 is inserted in opening 27 and is constructed in substantially the same way as the insert of U.S. Pat. No. 3,684,862 and can be connected to hotplate body 11. Sheet metal cap 28 has a cap jacket 29 extending approximately over the entire height of flanged rim 17 and projecting downwards related to the same. The upper end of cap jacket 29 passes via a ring rim extending approximately to the plane of the heating surface 13 into a planar cap bottom 30 positioned slightly slightly lower than heating surface 13 and which is at right angles to central axis 12. Over most of its extension, cap bottom 30 is provided with passages distributed in grating-like manner and is consequently constructed in this area as a perforated plate 31.

The venting duct 10 has two telescopically engageable tubes 32, 33, whereof the lower tube engages in the upper tube and extends downwards at least to the cover wall of the oven casing 8 and preferably projects slightly downwards through an opening in said cover wall. At the upper end, the upper tube 32 has an upwardly widened or outwardly bent stop rim 34 which, with its inside adjacent to the outer circumference of perforated plate 31, is resiliently engaged on the underside of the cap bottom 30 in this area, in which said cap bottom 30 cross-sectionally has a rim sloping up to the cap jacket 27, so that the tube 31 is automatically centered with respect to cap bottom 30. At the lower end, tube 32 has an inwardly directed ring rim 35 traversed by tube 33, so that tubes 33 and 32 are reciprocally contact free over most of their engagement length. Tube 33 has at its upper end located within tube 32 an outwardly projecting collar 36, which by striking against the ring rim 35 limits the reciprocal maximum draw-out length of the two tubes 32, 33. At its lower end, tube 33 is shaped to form a plug-in sleeve with a slightly larger diameter enabling it to be engaged on the upper end of a tube 38 of the baking oven muffle 7. Plug-in sleeve 37 forms on the inner circumference an annular stop shoulder 39 for the engagement of the upper end of tube 38, so that the axial position of tube 33 with respect to tube 38 is precisely defined. Tube 38 projects slightly over the top of cover wall of oven casing 8. Between the plug-in sleeve 37 and ring rim 35 on the outer circumference of tube 33 is provided a spring 40 in the form of a biased helical compression spring, which presses tube 32 upwards into its engaging position. The sheet metal cap 28 is provided at its lower end with an inwardly directed ring rim traversed by tube 32, so that the latter can on the one hand be guided on said ring rim and on the other with the ring rim 35 only on two axially spaced zones, whereby it is appropriate for tube 32 to be removable from the sheet metal cap 28. For the passage of venting duct 10, cover 23 has an opening relatively closely engaging around tube 32. A corresponding opening can also be provided in the further cover, but tube 32 can be drawn out through both covers. The lower end of tube 38 is fixed to the baking oven muffle 7 in the vicinity of an opening.

Figure 4:
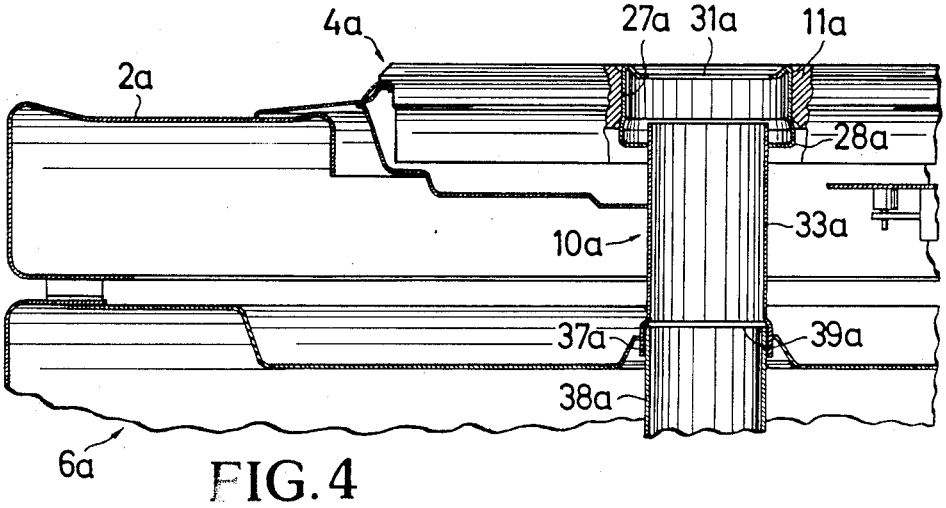
FIG. 4: Another embodiment in part sectional representation.
Figure 5:
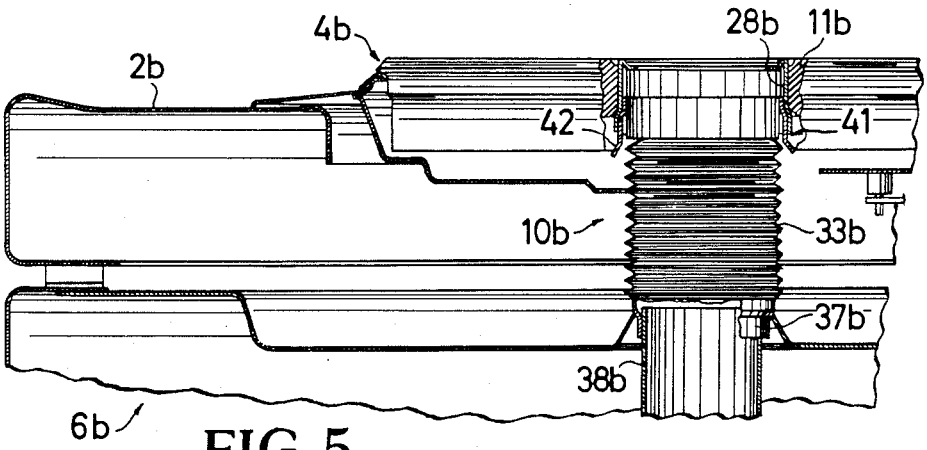
FIG. 5: Another embodiment in a representation corresponding to FIG. 4.

In FIGS. 4 and 5 corresponding parts are given the same reference numerals as in FIGS. 1 to 3, but in FIG. 4 are followed by "a" and in FIG. 5 by "b". In the embodiment according to FIG. 4, apart from the tube **38*a* of the baking oven muffle, venting duct 10*a* only has a single further tube 33*a*, which projects freely upwards and extends at leastup to the lower ring rim of the sheet metal cap 28*a* and preferably projects by a portion into the same. However, it is also conceivable for the upper end of tube 33*a* to surround the lower end of the sheet metal cap 28*a* on the outer circumference. The external diameter of tube 33*a* is smaller than the internal diameter of sheet metal cap 28*a* and is therefore completely contact-free with respect to the sealed electric hotplate, so that in the case of movements of said hotplate 4*a*** as a result of loading or stressing, no noise can occur.

In the embodiment according to FIG. 5 only one further tube is provided in comparable manner for forming the venting duct **10*b*, but said tube is constructed in one piece and in length-variable manner as a bellows 33*b* and its upper end is connected by means of an easily detachable locking connection 41 to electric hotplate 4*b*. The snap or locking connection 41 is provided on the circumference of the upper end of bellows 33*b* with radially resilient, freely downwardly projecting locking clips 42, which are distributed over the circumference and can engage in the lower ring rim of the sheet metal cap 28*b* in such a way that the upper end of the bellows 33*b* is connected to the sealed electric hotplate 4*b* in positionally fixed manner in the case of the usual limited vertical movements of said plate. However, if the hotplate 4*b* is raised upwards from the hob 2*b*, then the locking connection 41** is automatically disengaged and is then automatically restored again on reinserting the electric hotplate.

If a cooking vessel is located on the hotplate, the exit from the venting duct is admittedly as a rule not completely closed, because cooking vessels usually have a bottom which does not completely rest flat on the heatig surface. Besides ofthis, it is usually not likely that the hotplate having the venting duct will be used during operation of the oven.

I claim:

1. A cooker, comprising:

a hob (2) having at least one electric cooking point (3) provided with a cooking point heating surface (13), said heating surface extending from a center (14) to an outer circumference (15);

at least one electric heating element (20) for heating a particular cooking point (3);

a baking oven (6) positioned below the hob (2) and having an oven muffle (7);

a venting duct (10) guided upwards through said hob (2) at the cooking point (3), said venting duct providing a vent for the oven muffle, the venting duct having a lower end and an upper end, wherein the heating surface (13) is constructed as a substantially closed heating surface at least in a vicinity of the heating element (20), said heating element (20) being arranged in sealed encapsulated manner in a hot plate body (11) below the closed heating surface (13), said hot plate body forming the heating surface (13) and being traversed from a bottom side to the heating surface (13) by the venting duct (10).

2. A cooker according to claim 1, wherein the venting duct (10) passes through the hob (2) as a substantially closed channel.

3. A cooker according to claim 1, wherein the venting duct (10) passes as a substantially closed channel from the oven muffle (7) to the heating surface (13) of the hot plate body (11) and the heating surface is sealed except for the venting duct (10).

4. A cooker according to claim 1, wherein the hot plate body (11) has only a single passage opening (27) exclusively bonded on an outer circumference, said passage opening forming an upper end portion of the venting duct (10) engaging in the hot plate body (11).

5. A cooker according to claim 1, wherein the venting duct (10) defines a length extension, said venting duct (10) being formed by at least one tube (32, 33, 38) over at least part of its length extension.

6. A cooker according to claim 1, wherein means are provided for varying the length extension of the venting duct (10).

7. A cooker according to claim 1, wherein the venting duct (10) is constructed as a telescopic tube.

8. A cooker according to claim 1, wherein the venting duct (**10*b*) over at least part of its length is constructed as a bellows (33*b***).

9. A cooker according to claim 1, wherein a tube (**33*a*) of the venting duct (10*a*) projects freely upwards into the hotplate body (11*a***).

10. A cooker according to claim 1, wherein the upper end of the venting duct (10) is connected to the hotplate body (11).

11. A cooker according to claim 1, wherein means are provided for resiliently engaging the upper end of the venting duct (10) against the hotplate body (11) in an upward direction.

12. A cooker according to claim 1, wherein the upper end of the venting duct (**10*b*) is secured with respect to the hotplate body (11*b*) by means of an easily detachable snap connection (41**).

13. A cooker according to claim 1, further comprising a perforated plate (31) in the vicinity of the upper end of the venting duct (10), said perforated plate being positioned below the heating surface (13).

14. A cooker according to claim 1, further comprising a sheet metal cap (28) inserted in the hot plate body (11), said sheet metal cap having a cap jacket (29) and an upper perforated cap bottom (30) the upper end of the venting duct (10) engaging in the sheet metal cap (28).

15. A cooker according to claim 1, wherein the venting duct (10) is constructed as a substantially closed constructional unit, said unit being detachably mounted on a tube (38) projecting upwards from the oven muffle and further being inserted in the bottom side of the hot plate body (11).

16. A cooker according to claim 1, wherein the hotplate body (11) is part of a sealed electric hotplate (4) forming a constructional unit, said unit being easily detachably inserted in a receptacle of the hob (2), said heating element (20) of said unit being electrically connected by means of a detachable plug-in coupling.

17. A cooker according to claim 1, wherein the venting duct (10) is constructed as a substantially sealed constructional unit, said unit being detachably mounted on a tube (38) projecting upwards from the oven muffle and further being inserted in the bottom side of the hot plate body (11).

* * * * *

UNITED STATES PATENT AND TRADEMARK OFFICE

CERTIFICATE OF CORRECTION

PATENT NO. : 4,814,582

DATED : 3/21/89

INVENTOR(S) : Felix Schreder

It is certified that error appears in the above-identified patent and that said Letters Patent is hereby corrected as shown below:

Column 1, line 50 delete "of" and insert --to--.

Column 1, line 68, delete "cured" and insert --covered--

Column 2, line 9, delete "openign" and insert --opening--.

Column 2, line 24 delete "contactig" and insert --contacting--.

Column 3, line 11, delete "there" and insert --them--.

Column 4, line 49, delete "matchign" and insert --matching--.

Column 5, line 61, insert a space between "leastup".

Column 6, line 26-27, delete "heatig" and insert --heating--.

Column 6, line 27 insert a space between "ofthis".

Column 6, line 64, delete "bonded" and insert --bounded--.

Signed and Sealed this

Seventh Day of April, 1992

*Attest:*

HARRY F. MANBECK, JR.

*Attesting Officer*

*Commissioner of Patents and Trademarks*